United States Patent [19]

Hunt

[11] 4,165,896

[45] Aug. 28, 1979

[54] INSTRUMENT HOLDER FOR USE ON DISABLED HANDS

[76] Inventor: Alvin W. Hunt, 13778 Hiway 88, Lockeford, Calif. 95237

[21] Appl. No.: 856,917

[22] Filed: Dec. 2, 1977

[51] Int. Cl.[2] ..... A46B 5/02; B43K 23/00

[52] U.S. Cl. ..... 294/25; 15/443; 401/8

[58] Field of Search ..... 294/25; 15/437, 443; 30/232, 291, 298; 81/177 C; 131/258; 224/28 D, 28 F; 401/6–8

[56] References Cited

U.S. PATENT DOCUMENTS

| | | | |
|---|---|---|---|
| 426,324 | 4/1890 | Ramsey | 15/443 |
| 490,906 | 1/1893 | Helenbolt | 15/443 X |
| 565,374 | 8/1896 | Yarbrough | 15/443 |
| 952,002 | 3/1910 | Dwinell | 15/443 |
| 1,197,289 | 9/1916 | Henry | 15/443 |
| 1,342,576 | 6/1920 | Wride | 401/8 X |
| 2,889,160 | 6/1959 | Nelson | 294/25 X |

*Primary Examiner*—Johnny D. Cherry
*Attorney, Agent, or Firm*—Whann & McManigal

[57] ABSTRACT

An instrument holder for use on a disabled hand including a band being adapted to encircle the hand, the band having an instrument holding device adapted to support an instrument so as to extend from the holding device adjacent the forefinger, a latch within the holding device to removably secure an instrument therein, and expansible structure forming a part of the band to permit the band size to be varied according to the size of the hand.

12 Claims, 8 Drawing Figures

INSTRUMENT HOLDER FOR USE ON DISABLED HANDS

BACKGROUND OF THE INVENTION

The present invention relates to devices which may be used on a partially disabled or a disabled hand whereby the hand may be enabled to become functional to use instruments attached to the device according to the invention.

There are a number of prosthetics devices adapted for use with non-functional hands but for the most part they are rather expensive and complicated. The present invention is very simple in structure and relatively inexpensive to manufacture.

SUMMARY OF THE INVENTION

The present invention is essentially a rigid band adapted to be fit over the hand in the area of the fingers or in the area inwardly of the fingers between the said areas and the thumb.

Accordingly, it is an object of the present invention to provide an improved device for use on a non-functional or pratically non-functional hand, by which the hand can operate various tools and instruments held in the device.

It is another object of the invention to provide a device, as described in the preceding paragraph, which is essentially a band adapted to be fitted over the hand between the fingers and the thumb or over the area just inwardly of the knuckles. The band is expansible so that it can be varied in size as needed for a particular hand size.

It is still another object of the invention to provide a device, as described in the preceding paragraphs, which is substantially rigid so that considerable force can be applied through it between the hand and the instrument attached to the device.

It is a further object of the invention to provide a device, as described in the preceding paragraphs, having means for carrying various instruments in various positions of rotation with respect to the hand.

It is a still further object of the invention to provide a device, as described in the preceding paragraphs, in which the instruments are inserted in a tubular portion thereof and automatically latched in place. Means are also provided by which the instruments are easily unlatched for removal.

Further objects and advantages of the invention may be brought out in the following part of the specification, wherein small details have been described for the competence of disclosure, without limiting the scope of the invention which is set forth in the claims.

BRIEF DESCRIPTION OF THE DRAWINGS

Referring to the accompanying drawings, which are for illustrative purposes.

DESCRIPTION OF THE PREFERRED EMBODIMENT

Figure 1:
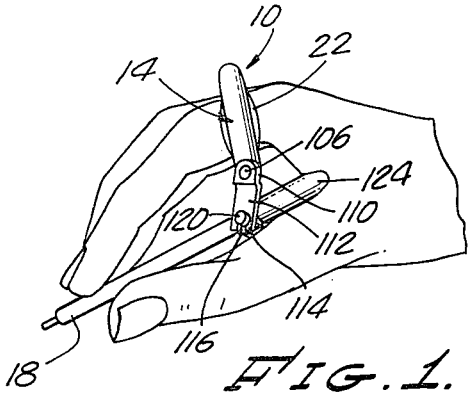
FIG. 1 is a side elevational view of a hand having the present invention thereon and in which the instrument being operated is a ball point pen.
Figure 2:
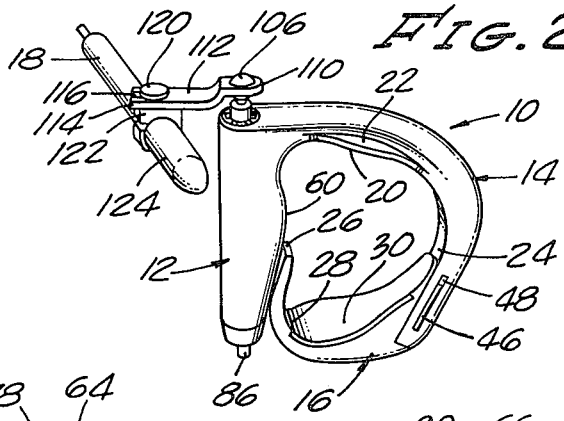
FIG. 2 is a perspective view of the device shown in FIG. 1 on the hand.
Figure 3:
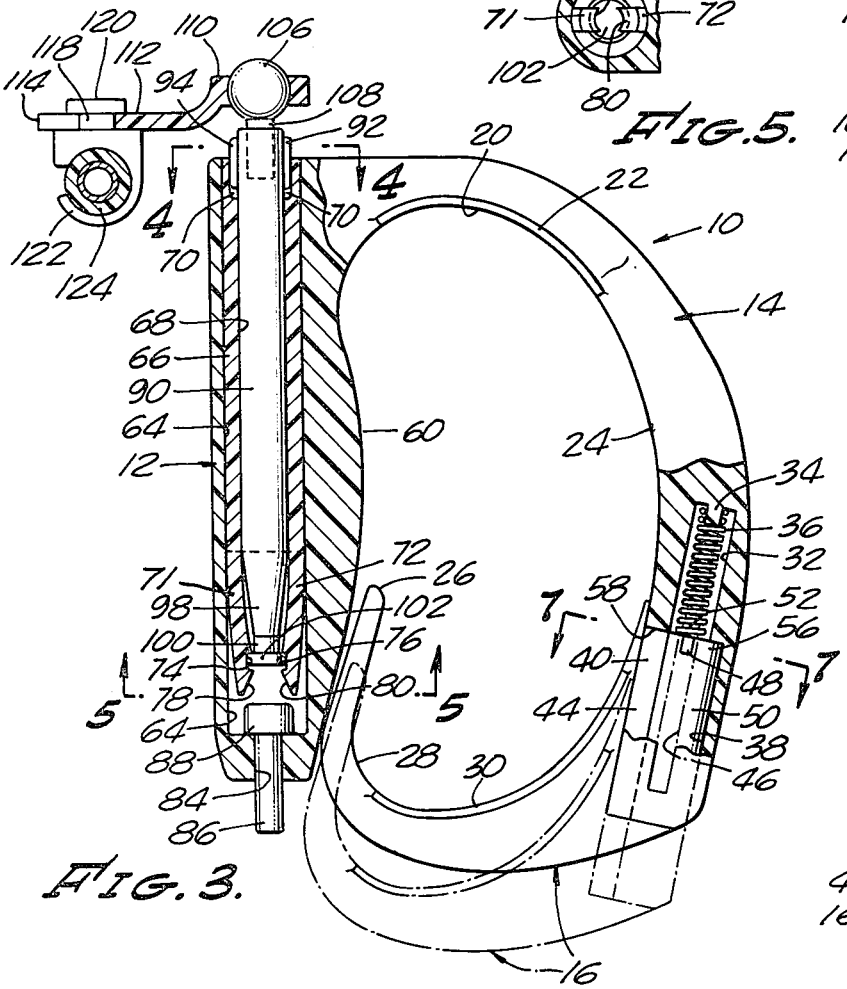
FIG. 3 is a side elevational view of the device, shown in FIG. 2, partially in cross-section and illustrating the expansion of the device for different size hands.
Figure 5:
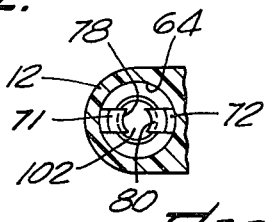
FIG. 5 is a fragmentary partially cross-sectional view taken along the line 5—5 in FIG. 3.

Referring again to the drawings, there is shown in FIGS. 1–3, an instrument holder generally designated as 10, adapted to be fitted over the fingers of a disabled hand, FIG. 1, between the fingers and the thumb. Depending upon the use to which an instrument is to be put and the condition of the hand, the instrument holder may also be moved farther inwardly on the hand beyond the fingers.

The device is comprised generally of an oval band formed of three parts, namely, an instrument holding member 12, an upper band portion 14, and a lower expandible band portion 16. The structure is substantially rigid so that it will not flex and lose some of the force being applied from the hand through the band and to an instrument, such as a pen 18.

The upper part 14 of the band has a curved interior surface 20 to substantially mate with the upper edge of the forefinger or part of the hand inwardly of the forefinger. The surface 20 is widened to form a flange portion as 22, FIG. 2, to provide additional surface against which the hand works. This additional surface provides more effective force transfer from the hand to the band and also prevents abrasion to the hand that might occur if the surface were narrower. Below the surface 20 is an inner curved surface 24 generally flat in cross-section and which is adapted to the contour of the back of the hand or fingers against which it fits.

The expansible portion 16 is interrupted from the remainder of the band at an upper end 26. Extending downwardly from the end 26 is a curved portion 28 having a configuration to fit over the front of the fingers or the palm of the hand. Below the portion 28 is a bottom inner curved and widened portion 30 which is adapted to provide an additional surface against which the lower part of the hand or little finger can work, and also is wide enough so as not to cause any abrasion on the portion of the hand it contacts.

Figure 7:
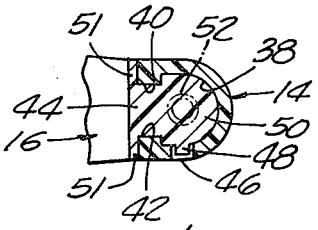
FIG. 7 is a fragmentary cross-sectional view taken along the line 7—7 in FIG. 3.

The expansible portion 16 of the band, FIGS. 2 and 7, is slidably engaged with the portion 14. Centrally within the portion 14 is a cylindrical bore 32 having a downwardly extending cylindrical pin 34 at its upper end and to which a coil spring 36 is attached. Below the lower end of the bore 32 is an elongated, substantially semicircular groove 38 in the portion 14 and extending inwardly from the groove 38 is a continuation thereof having parallel flat opposite sides 40 and 42. Between the sides 40 and 42 the member 14 has an elongated slot 44. A slot 46 is cut into the portion 14 extending downwardly and outwardly from the groove 38 so as to receive a guide pin 48 of a portion 50 of the expansible part 16. The portion 50 is complementary to the semicircular groove 38 and the area between the sides of 40 and 42 of the portion 14, so that the expansible portion 16 is slidable with respect to the portion 14. On the part 16 outwardly of the slot 44 is a pair of flanges 51, 51 slidably engaged with part 14. The flanges 51, 51 form an upper part of the curved surface 30.

Extending upwardly from the portion 50 is a cylindrical pin 52 to which the spring 36 is connected at its lower end. Thus the spring permits and limits the downward slidable movement of the expansible member 16 from the portion 14 to enlarge the length of the band according to the size of the hand. The spring 36 holds the portion 16 inwardly in the retracted position, so that an upper end 56 of the portion 50 abuts a shoulder 58 outwardly of the top of the groove 38. At its upper position the pin 48 also abuts the lower surface of the portion 14 outwardly of the groove 38. Thus when the expansible member 16 is moved downwardly to enlarge the band, the member 50 and the pin 48 slide downwardly stretching the spring 36. When the band is fitted on the hand the expansible portion 16 is retracted by the spring so that the portion 30 fits on the lower edge of the hand or the little finger.

The band portion 12 has an inner convex curved surface 60 complementary to the hand and extends downwardly beyond the end 26 of the expansible portion 16, both in the fully expanded position and the fully retracted position. The band portion 12 has a cylindrical bore 64, FIGS. 3–6, and fitted therein is a generally cylindrical tube 66 made of plastic or other suitable material. The tube 66 has a cylindrical bore 68 and at its upper end has a plurality of circumferentially spaced radial grooves 70 extending longitudinally downwardly into the tube.

At the lower end of the tube 66 is a pair of opposing elongated spring members 71 and 72 extending along the wall of the bore 64. Near their lower ends the members 71, 72 have inwardly opposing notches 74, 76 and extending from the notches are downwardly tapering surfaces 78 and 80, respectively, terminating at the lower ends of the springs.

At the lower end of the bore 64 is a small diameter bore 84 having a plunger actuator 86 slidably engaged therein. At the upper end of the actuator is a plunger 88 within the bore 64.

Figure 4:
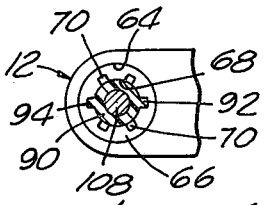
FIG. 4 is a fragmentary view taken along the line 4—4 in FIG. 3.

The bore 68 is adapted to receive rods, as 90, to which instruments operated by the holder 10 are connected. Each rod 90 has a pair of diametrically opposed radial splines 92 and 94, adapted to be fitted within the grooves 70 to fix the rod 90 in the desirable position for operating the instrument attached thereto. As shown in FIG. 4 there are six possible positions to insert the two splines.

Figure 6:
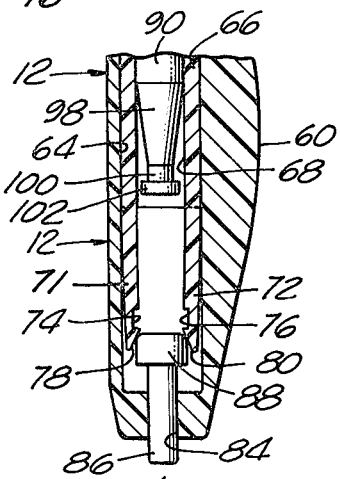
FIG. 6 is a cross-sectional fragmentary view illustrating the unlatching of the instrument from the holding device.

At the lower end of the rod 90 there is a tapered portion 98 terminating in a small diameter part 100 and on which is fitted a cylindrical flange 102 as shown in FIG. 3. When the rod 90 is fully inserted the flange 102 is snapped into the notches 74 and 76 of the springs 71 and 72 so as to latch the rod in the band. As shown in FIG. 6, when the actuating member 86 is pushed inwardly the plunger 88 moves against the tapered surfaces 78 and 80 to spread the springs apart and release the flange 102 so that the instrument rod can be removed from the band.

By way of example, one type of instrument to be operated by the band on the hand or fingers, FIGS. 1–3, is pen 18 secured to the rod 90 by a ball and socket and linkage arrangement. The ball 106 has a pin 108 at its lower end fixed in the upper end of a rod 90 and a socket member 110 is rotatably fitted thereon. A leg 112 extends from the socket member and its end 114 has a groove 116 extending therein. Fitted in the groove 116 is a pin 118 with a flanged top 120 extending on the surface of the leg 112. Pin 118 is connected to a pen holding member 122 having a cylindrical opening, not shown, in which the pen is slidably engaged. A pen cap 124 abuts the member 122 to hold the pen in place.

The pen 18 is capable of multiple rotations with respect to the band by means of the ball and socket arrangement and further by means of the rotation of the member 122 in the leg 112 so that the pen can be positioned almost anywhere with respect to the fingers. In this arrangement the pen requires very little or no gripping but will function with a slight pressure of at least one finger or the weight thereof. The actual movement of the pen depends upon the movement of the hand or arm exerted through the instrument holder 10.

Figure 8:
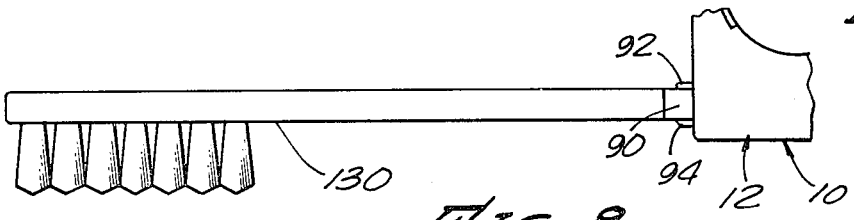
FIG. 8 is a fragmentary view of the device in which the instrument held therein is a toothbrush.

It is understood that many other types of instruments may be operated by the holder 10 as indicated in FIG. 8, where a rod 90 having splines 92, 94 fitted in a pair of grooves 70, has a toothbrush 130 connected thereto. Numerous other instruments such as a comb, fork, spoon, nail file, and knife may be operated by the instrument holder 10.

The invention and its attendant advantages will be understood from the foregoing description, and it will be apparent that various changes may be made in the form, construction and arrangement of the parts of the invention without departing from the spirit and scope thereof or sacrificing its material advantaged, the arrangements hereinbefore described merely being by way of example. I do not wish to be restricted to the specific forms shown or uses mentioned, except as defined in the accompanying claims, wherein various portions have been separated for clarity of reading and not for emphasis.

I claim:

1. An instrument holder for use on a disabled hand, said holder comprising:

a band being adapted to encircle the fingers of a hand free of the thumb or encircle the hand over the palm and back free of the thumb;

said band having instrument holding means at one side thereof adapted to support an instrument so as to extend from the holding means adjacent the forefinger and upper end of the holding means;

latch means within said holding means to removably secure an instrument therein;

expansible means forming a part of said band to permit the band size to be varied according to the size of the hand;

said expansible means being interrupted at one end thereof from the remainder of the band on one side thereof;

a second end of said expansible means being slidably engaged with the remainder of said band at a second side opposite said one side; and a spring connecting said second end of said expansible means with said second side and biasing said expansible means toward said remainder of said band.

2. An instrument holder for use on a disabled hand, said holder comprising:

a band being adapted to encircle the fingers of a hand or encircle the hand over the palm and back free of the thumb;

said band having instrument holding means at one side thereof adapted to support an instrument so as to extend from the holding means adjacent the forefinger and upper end of the holding means;

latch means within said holding means to removably secure an instrument therein;

expansible means forming a part of said band to permit the band size to be varied according to the size of the hand;

said holding means being a tubular member along said one side of said band;

said tubular member having an upper receiving opening adapted to be adjacent the forefinger;

said tubular member adapted to receive a rod on the end of an instrument through said receiving opening;

said receiving opening being generally cylindrical and having a plurality of circumferentially spaced, radial grooves extending outwardly therefrom and extending longitudinally in said tubular member; and said grooves being adapted to receive longitudinal splines extending radially from adjacent an upper end of said rod to position the instrument properly with respect to the band and hand.

3. The invention according to claim 2, in which:

said latch means is within said tubular member and is comprised of diametrically spaced elongated spring members extending along a lower wall portion of said tubular member and being biased inwardly therefrom;

said spring members having inwardly opening notches adjacent their lower ends;

said spring members having downwardly and outwardly tapering inner surfaces below said notches and terminating at the lower ends of the spring members;

said rod tapering toward its lower end to form a small diameter portion adjacent its lower end and an enlarged diameter cylindrical flange forming the lower end immediately below the small diameter portion; and said flange being adapted to snap into said notches when inserted into said tubular member and thereby be latched in said tubular member.

4. The invention according to claim 3, in which:

said tubular member has an opening at its lower end, a plunger actuator extending outwardly from said lower end and being slidably engaged therein, a plunger on said actuator within said tubular member adjacent said lower ends of the spring members, said plunger being slidable in said tubular member and having a larger diameter than said last opening to be retained therein, and said plunger being adapted to be moved inwardly by said actuator between said tapering surfaces to move the notches outwardly from the enlarged diameter flange and release the rod in the tubular member.

5. The invention according to claim 2, in which:

said rod has a ball on its upper end, a socket member having a socket fitted for rotation on said ball, said socket member extending outwardly from said socket and terminating in an outer end, and said outer end being rotatably connected to an instrument whereby said instrument can be rotated at multiple angles to and multiple directions with said band and hand.

6. The invention according to claim 2, in which:

said latch means is within said tubular member and is adapted to latchingly engage with means on said rod to hold said rod therein, and means extending outwardly of said tubular member to disengage said latch means from said rod and release said rod therefrom.

7. An instrument holder for use on a disabled hand, said holder comprising:

a band being adapted to encircle the fingers of a hand free of the thumb or encircle the hand over the palm and back free of the thumb, said band having instrument holding means at one side thereof adapted to securely support an instrument so as to extend from the holding means adjacent the forefinger knuckle and upper end of the holding means, self-adjusting means forming a part of said band to permit the band size to be varied according to the size of the band, said self-adjusting means being interrupted at one end thereof from the remainder of the band on one side thereof, a second end of said self-adjusting means being slidably engaged with the remainder of said band at a second side opposite said one side, and a spring connecting said second end of said self-adjusting means with said second side and biasing said self-adjusting means toward said remainder of said band.

8. An instrument holder for use on a disabled hand, said holder comprising:

a band being adapted to encircle the fingers of a hand free of the thumb or encircle the hand over the palm and back free of the thumb, said band having instrument holding means at one side thereof adapted to securely support an instrument so as to extend from the holding means adjacent the forefinger knuckle and upper end of the holding means, said holding means is a tubular member along said one side of said band, said tubular member having an upper receiving opening adapted to be adjacent the forefinger, said tubular member adapted to receive a rod adjacent the end of an instrument through said receiving opening, said receiving opening being generally cylindrical and having a plurality of circumferentially spaced, radial grooves extending outwardly therefrom and extending longitudinally in said tubular member, said grooves being adapted to receive longitudinal splines extending radially from adjacent an upper end of said rod to position the instrument properly with respect to the band and hand, and self-adjusting means forming a part of said band to permit the band size to be varied according to the size of the hand.

9. The invention according to claim 8, including:

latch means within said holding means to removably secure an instrument thereon;

said latch means being within said tubular member and being comprised of diametrically spaced elongated spring members extending along a lower wall portion of said tubular member and being biased inwardly therefrom;

said spring members having inwardly opening notches adjacent their lower ends;

said spring members having downwardly and outwardly tapering inner surfaces below said notches and terminating at the lower ends of the spring members;

said rod tapering toward its lower end to form a small diameter portion adjacent its lower end and an enlarged diameter cylindrical flange forming the lower end immediately below the small diameter portion; and said flange being adapted to snap into said notches when inserted into said tubular member and thereby be latched in said tubular member.

10. The invention according to claim 9, in which:

said tubular member has an opening at its lower end, a plunger actuator extending outwardly from said lower end and being slidably engaged therein, a plunger on said actuator within said tubular member adjacent said lower ends of the spring members, said plunger being slidable in said tubular member and having a larger diameter than said last opening to be retained therein, said plunger being adapted to be moved inwardly by said actuator between said tapering surfaces to move the notches outwardly from the enlarged diameter flange and release the rod in the tubular member.

11. The invention according to claim 8, in which:

said rod has a ball on its upper end, a socket member having a socket fitted for rotation on said ball, said socket member extending outwardly from said socket and terminating in an outer end, said outer end being rotatably connected to an instrument whereby said instrument can be rotated at multiple angles to and multiple directions with said band and hand.

12. An instrument holder for use on a disabled hand, said holder comprising:

a band being adapted to encircle the fingers of a hand free of the thumb or encircle the hand over the palm and back free of the thumb, said band having instrument holding means at one side thereof adapted to securely support an instrument so as to extend from the holding means adjacent the forefinger knuckle and upper end of the holding means, said holding means being a tubular member along said one side of said band, said tubular member having an upper receiving opening adapted to be adjacent the forefinger, said tubular member adapted to receive a rod adjacent the end of an instrument through said receiving opening, latch means within said holding means to removably secure an instrument therein, said latch means being within said tubular member and being adapted to latchingly engage with means on said rod to hold said rod therein, means extending outwardly of said tubular member to disengage said latch means from said rod and release said rod therefrom, and self-adjusting means forming a part of said band to permit the band size to be varied according to the size of the hand.

* * * * *